US008459759B2

(12) United States Patent
Kang et al.

(10) Patent No.: US 8,459,759 B2
(45) Date of Patent: Jun. 11, 2013

(54) REFRIGERATOR AND DRAWER OPENING/CLOSING APPARATUS FOR THE SAME

(75) Inventors: Byeong-Gyu Kang, Changwon (KR); Jae-Youl Lee, Gimhae-si (KR); Ki-Hoon Song, Suwon-si (KR); Jeong-Ho Shin, Changwon (KR)

(73) Assignee: LG Electronics Inc., Seoul (KR)

( * ) Notice: Subject to any disclaimer, the term of this patent is extended or adjusted under 35 U.S.C. 154(b) by 673 days.

(21) Appl. No.: 12/530,949

(22) PCT Filed: Mar. 14, 2008

(86) PCT No.: PCT/KR2008/001453

§ 371 (c)(1),
(2), (4) Date: Dec. 22, 2009

(87) PCT Pub. No.: WO2008/111817

PCT Pub. Date: Sep. 18, 2008

(65) Prior Publication Data

US 2010/0101266 A1 Apr. 29, 2010

(30) Foreign Application Priority Data

Mar. 14, 2007 (KR) ..... 10-2007-0024763

(51) Int. Cl.
*A47B 96/04* (2006.01)

(52) U.S. Cl.
USPC ..... 312/402; 312/302; 312/404

(58) Field of Classification Search
USPC ..... 312/402, 404, 298, 301, 302, 303, 312/291
See application file for complete search history.

(56) References Cited

U.S. PATENT DOCUMENTS

| | | | | | |
|---|---|---|---|---|---|
| 345,227 | A | * | 7/1886 | Fraser | 312/334.32 |
| 472,523 | A | * | 4/1892 | Chain | 296/58 |
| 2,272,537 | A | * | 2/1942 | West | 312/192 |
| 2,843,441 | A | * | 7/1958 | Jewell | 312/301 |
| 2,885,251 | A | * | 5/1959 | Howard | 312/222 |
| 3,212,835 | A | * | 10/1965 | Beckett et al. | 312/311 |
| 3,295,908 | A | * | 1/1967 | Dawley et al. | 312/303 |
| 5,586,817 | A | * | 12/1996 | Hubbard et al. | 312/334.44 |
| 2004/0183415 | A1 | * | 9/2004 | Kim | 312/402 |
| 2006/0049731 | A1 | * | 3/2006 | Choi et al. | 312/330.1 |
| 2006/0218958 | A1 | * | 10/2006 | Rand et al. | 62/302 |
| 2007/0035221 | A1 | * | 2/2007 | Koo | 312/404 |

FOREIGN PATENT DOCUMENTS

| | | | |
|---|---|---|---|
| KR | 10-2004-0082705 | A | 9/2004 |
| KR | 10-2006-0062148 | A | 6/2006 |
| KR | 10-2007-0004359 | A | 1/2007 |

* cited by examiner

*Primary Examiner* — Darnell Jayne
*Assistant Examiner* — Andres F Gallego
(74) *Attorney, Agent, or Firm* — Birch, Stewart, Kolasch & Birch, LLP

(57) ABSTRACT

A refrigerator and a drawer opening/closing apparatus for a refrigerator wherein a main drawer and an auxiliary drawer are drawn at the same time or independently, the convenience of use is advantageously improved because it is possible for an user to automatically open the auxiliary drawer without directly opening the auxiliary drawer.

13 Claims, 5 Drawing Sheets

REFRIGERATOR AND DRAWER OPENING/CLOSING APPARATUS FOR THE SAME

TECHNICAL FIELD

This document relates to a refrigerator and a drawer opening/closing apparatus for the same.

BACKGROUND ART

Generally, a refrigerator is an electronic appliance which is maintained at a relatively low temperature in order to keep foodstuffs fresh for a long time.

Specifically, the refrigerator is provided with a refrigerating chamber that is maintained at a temperature of 1~4° C. in order to preserve foodstuffs such as vegetables, and a freezing chamber that is maintained at a temperature of −18° C. or less in order to preserve foodstuffs such as meat or fish in a frozen state.

Also, the refrigerator may be classified into a top mount type refrigerator where the freezing chamber is located above the refrigerating chamber, a bottom freezer type refrigerator where the freezing chamber is located below the refrigerating chamber, and a side by side type refrigerator where the refrigerating and freezing chambers are located adjacent to each other from side to side.

Also, the refrigerator may be classified into a double door refrigerator of which doors are respectively installed at both sides, and a single door refrigerator of which doors are respectively installed in a vertical direction.

Meanwhile, a drawer type food storage container is provided in the freezing chamber of the bottom freezer type refrigerator where the freezing chamber is located at the lower side. Specifically, a main drawer having a size corresponding to the most part of an inner space of the freezing chamber and an auxiliary drawer located above the main drawer are provided in the freezing chamber of the bottom freezer type refrigerator.

However, the refrigerator, of which the food storage container is configured as a drawer, especially the refrigerator, of which the door is connected to the main drawer and the auxiliary drawer is located above the main drawer, has following problems.

Specifically, an operation which draws a freezing chamber door to open the main drawer, and an operation which draws a doorknob of the auxiliary drawer to open the auxiliary drawer have to be carried out in sequence so that an user draws foodstuffs stored in the auxiliary drawer. Hence, the user has to inconveniently carry out two operations in order to draw the foodstuffs.

In addition, loss of cold air is disadvantageously caused, as the inner space of the freezing chamber is exposed to external air at the room temperature longer periods of time. Further, the freezing chamber load is increased by the cold air loss, thereby increasing the power consumption.

Also, in order to close the freezing chamber door, the user has to close the auxiliary drawer before closing the main drawer.

In case the user closes the main drawer together with the auxiliary drawer by pushing the main drawer only in order to close these drawers in a state that the main and auxiliary drawers are opened, some of the drawer or door is scratched or damaged as an inner-circumference surface of the freezing chamber door is hit by a front surface of the auxiliary drawer.

DISCLOSURE OF INVENTION

Technical Problem

The present invention is conceived to solve the aforementioned problems, and an object of the present invention is to provide a refrigerator where opening an auxiliary drawer can be achieved only by opening a refrigerator door. That is, an object of the present invention is to provide a refrigerator where a main drawer, which is connected to a rear surface of the door, and an auxiliary drawer, which is drawably provided in a freezing or refrigerating chamber and is not connected to the door, can be simultaneously opened.

Also, another object of the present invention is to provide a refrigerator where the auxiliary drawer is closed by closing the freezing chamber door without interfering with the freezing chamber door in a state that all of the main and auxiliary drawers are opened.

Technical Solution

To achieve the objects of the present invention, as embodied and broadly described herein, there is provided a refrigerator, including: A refrigerator, comprising: a body in which a cold air receiving space is provided; a main drawer and an auxiliary drawer provided in the cold air receiving space; a door tiltably provided at a front of the main drawer to open/close the cold air receiving space; and an opening/closing apparatus provided at one side of the main and auxiliary drawers, the opening/closing apparatus enabling the main and auxiliary drawers to be simultaneously drawn out.

In another aspect of the present invention, there is provided a refrigerator, including: a body in which a space for storing food is provided; a main drawer drawably received in the space; an auxiliary drawer drawn out independently or simultaneously with the main drawer; a door tiltably provided at a front of the main drawer; an opening/closing apparatus for open and close the main drawer and/or the auxiliary drawer, wherein the opening/closing apparatus includes, a blocking projection protruded at a lower end of the auxiliary drawer, and a dragger provided at an upper surface of the main drawer and lifted selectively to contact the blocking projection according to the tilting of the door.

Also, there is provided a drawer opening/closing apparatus for a refrigerator, including a shaft moving along a side surface of a main drawer in a back-and-forth direction according to the state of a door which is tiltably provided at a front of the main drawer; a cam integrally connected to a predetermined portion of the shaft; a stopper integrally connected to a predetermined portion of the shaft; a plurality of sliding guides fixed to a side surface of the main drawer to guide the movement of the shaft; a dragger provided at an upper surface of the main drawer, and raised and lowered by the cam; and a blocking projection provided at a side lower end of the auxiliary drawer which is disposed above the main drawer, the blocking projection beingselectively contacted with the dragger.

Advantageous Effects

According to the refrigerator of the present invention, a plurality of drawers provided in a freezing or refrigerating chamber can be opened/closed by a single operation of opening/closing a door.

In other words, an user may open/close an auxiliary drawer by a simple operation, since the auxiliary drawer is opened or closed together with a main drawer while opening/closing the main drawer.

Also, since the auxiliary drawer is opened or closed a single operation of opening/closing a refrigerator door, the loss of cold air can be minimized and therefore the power consumption can be also minimized.

MODE FOR THE INVENTION

Hereinafter, the preferred embodiments of present invention will be explained in detail with reference to the accompanying drawings. However, the concept of the present invention is not to be limited to these embodiments and those skilled in the art will appreciate that various modifications, additions and substitutions are possible, without departing from the scope and spirit of the invention as disclosed in the accompanying claims.

Reference will now be made in detail to a bottom freezer type refrigerator where a freezing chamber is located below a refrigerating chamber to explain the spirit of the present invention. However, it is noted that the scope of the present invention is not restricted the above-described embodiments, but it can be applied to all kinds of refrigerators where the inside of a refrigerating or freezing chamber is composed of a plurality of drawers.

Figure 1:
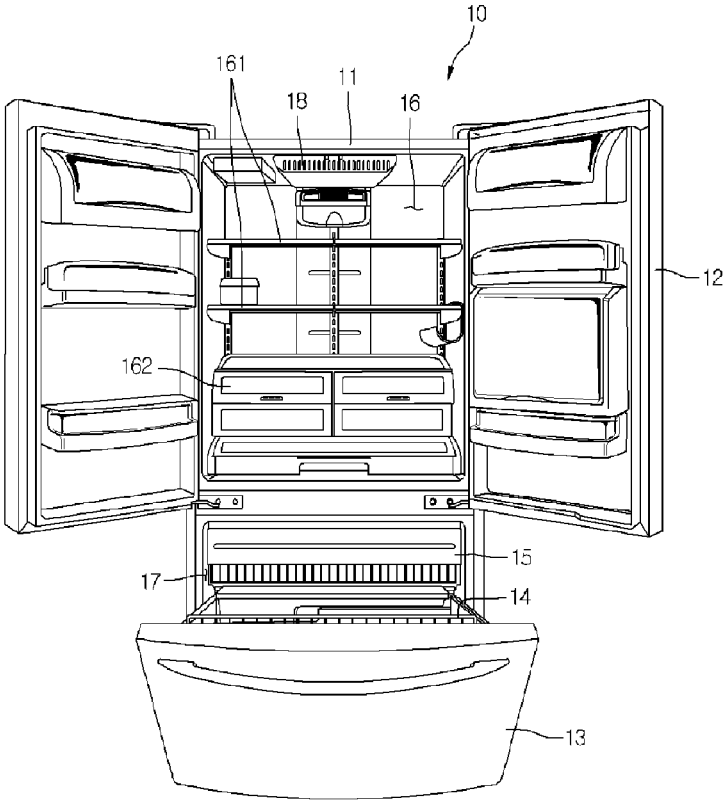
FIG. 1 is a front perspective view of a refrigerator according to a preferred embodiment of the present invention.
Figure 2:
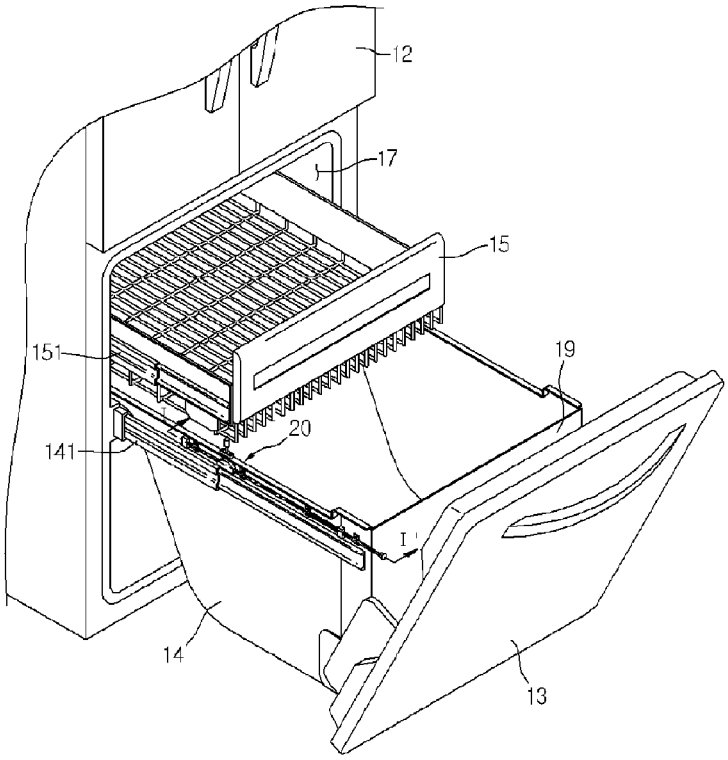
FIG. 2 is a partial perspective view showing a freezing chamber, which is opened, of a refrigerator according to a preferred embodiment of the present invention.

FIG. 1 shows a refrigerator according to a preferred embodiment of the present invention in a front perspective view, and FIG. 2 shows a freezing chamber, which is opened, of a refrigerator according to a preferred embodiment of the present invention in a partial perspective view.

Referring to FIGS. 1 and 2, the refrigerator 10 according to the embodiment of the present invention includes a body 11 forming an appearance of the refrigerator and provided with a freezing chamber 17 and a refrigerating chamber 16 disposed therein, a refrigerating chamber door 12 for opening/closing the refrigerating chamber 16, and a freezing chamber door 13 for opening/closing the freezing chamber 17.

Specifically, the refrigerating chamber 16 is located above the freezing chamber 17, and a front of the refrigerating chamber is selectively opened or closed by a pair of refrigerating chamber doors 12. Here, only a single refrigerating chamber door 12 may be provided, so that it may be pivotably installed at one side of the body 11.

Also, a plurality of shelves 161 and a plurality of drawers 162, on which foodstuffs are placed, are provided in the refrigerating chamber 16. And, a cold air duct 18, which allows cold air passed through an evaporator to be supplied into the refrigerating chamber 16, is provided at a rear surface of the refrigerating chamber 16. Specifically, the cold air duct 18 is communicated with the freezing chamber 17, so that some of the cold air passed through the evaporator is supplied into the freezing chamber 17 and the rest of the cold air is supplied into the refrigerating chamber 16.

Meanwhile, the freezing chamber 17 is provided below the refrigerating chamber 16, and it is selectively opened/closed by the freezing chamber door 13.

Specifically, the freezing chamber door 13 is provided in a size sufficient to cover all of the front of the freezing chamber 17. And, a main drawer 14 having a relatively large food storage space, and an auxiliary drawer 15 provided above the main drawer 14 and having a relatively small food storage space are provided in the freezing chamber 17. And, a frame 19 for supporting the main drawer 14 is provided on a rear surface of the freezing chamber door 13, and a lower end of the rear surface of the freezing chamber door 13 is pivotably connected to a lower end of a front surface of the frame 19.

Also, a guide rail 141, 151 is respectively provided at a side surface of the main drawer 14 and auxiliary drawer 15, so that the main drawer 14 and auxiliary drawer 15 can be drawn from the body 11 at a predetermined length. Here, to be more exact, the guide rail 141 provided at the side surface of the main drawer 14 is connected to a side surface of the frame 19. And, the main drawer 14 is detachably connected to an inside of the frame.

According to this structure, the freezing chamber door 13 can be opened in a tilted state or in a vertical state that is perpendicular to a floor.

Also, an opening/closing apparatus 20 is provided at one side of the main drawer 14 and one side of the auxiliary drawer 15 so that the auxiliary drawer 15 can be drawn together with the main drawer 14 while the main drawer 14 is drawn. Of course, the auxiliary drawer 15 can also be pushed in the body 11 while the main drawer 14 is pushed therein. And, the freezing chamber door 13 and the auxiliary drawer 15 cannot be interfered with each other during the main drawer 14 is closed according to whether the door 13 is tilted. Here, to be more exact, the opening/closing apparatus 20 is also connected to the side surface of the frame 19. However, the opening/closing apparatus 20 may be fixed in the side surface of the main drawer 14. The inventive concept of the present invention is that the opening/closing apparatus 20 is provided a side of the main drawer 14 to interconnect with the auxiliary drawer 15.

Also, as described in the above, the freezing chamber door 13 can be opened in a tilted state or in a vertical state depending on the user's selection. In other words, when the user pulls a doorknob of the freezing chamber door 13 by applying a force less than a predetermined strength, the freezing chamber door 13 is opened in a vertical state. On the contrary, when the user pulls the freezing chamber door 13 by applying a force greater than a predetermined strength, the freezing chamber door 13 is opened in a tilted state. Even though it is not illustrated, a tilting lock, which allows the freezing chamber door 13 to be selectively tilted according to the strength of the pulling force, may be provided at a rear surface of the freezing chamber door 13 and a front surface of the frame 19.

Hereinafter, the structure and operation of the opening/closing apparatus 20 will be explained in detail with reference to the accompanying drawings.

Figure 3:
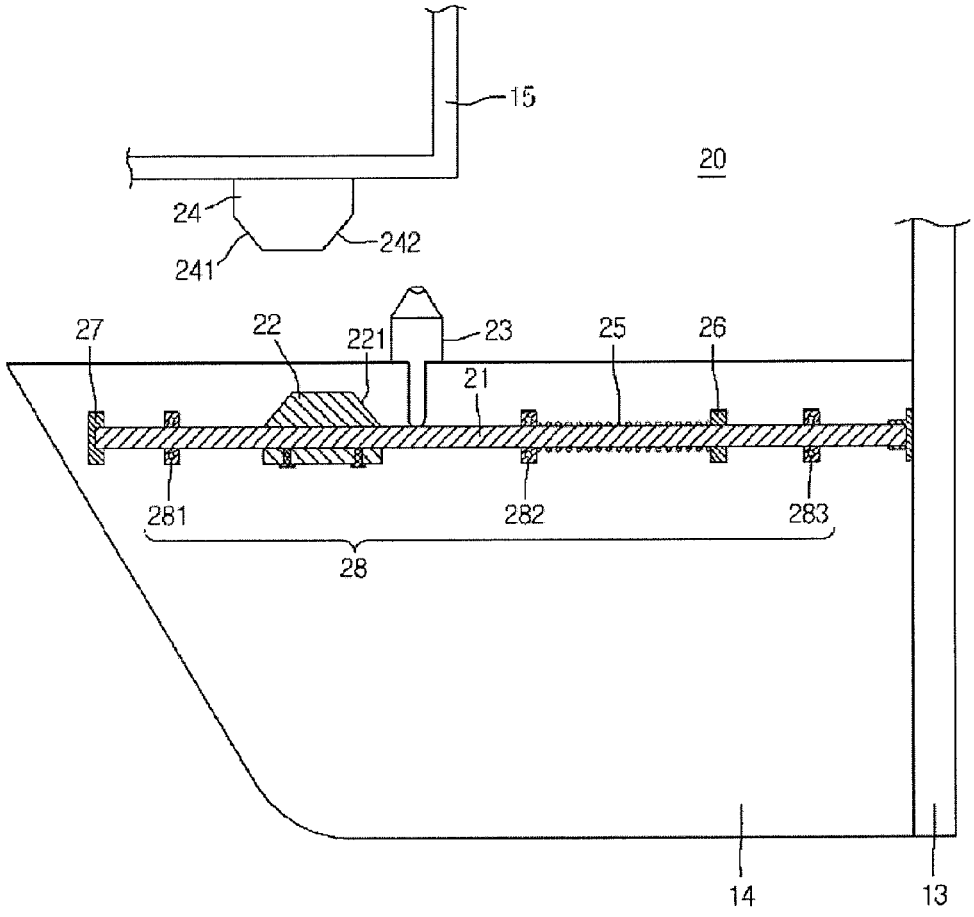
FIG. 3 is a cross-sectional view taken along I-I' in FIG. 2.

FIG. 3 is a cross-sectional view taken along I-I' in FIG. 2.

Referring to FIG. 3, the opening/closing apparatus 20 according to the embodiment of the present invention is installed at one side of the main drawer 14, and a side of the auxiliary drawer 15 provided above the main drawer 14, respectively.

Specifically, the opening/closing apparatus 20 provided at one side of the main drawer 14 includes a shaft 21 which is extended along the side surface of the main drawer 14 in a back-and-forth direction for a predetermined length and is translated, a plurality of sliding guides 28 which guides the movement of the shaft 21, a spring 25 which provides an elastic force causing the movement of the shaft 21, a cam 22 which is connected to any point of the shaft 21, and a dragger 23 which is provided at the upper part of the main drawer 14 and is lifted and lowered along a surface of the cam 22.

More specifically, the opening/closing apparatus 20 further includes a first stopper 26 which is integrally connected with the shaft 21 at a point spaced forwardly from the cam 22, and a second stopper 27 which is integrally connected to a rear end of the shaft 21. Here, the second stopper 27 can be dispensed with.

Also, the sliding guide 28 includes a first sliding guide 281 provided at a rear side of the shaft 21, a second sliding guide 282 provided ahead of the cam 22 and a third sliding guide 283 provided at a front end of the shaft 21. And, the sliding guide 28 is fixed to a side surface of the main drawer 14 (or a side surface of the frame).

According to this structure, the second stopper 27 is disposed at the back of the first sliding guide 281, and the cam 22 is moved between the first and second sliding guides 282, 283 in a back-and-forth direction. And, the first stopper 26 is is moved between the first and second sliding guides 282, 283 in a back-and-forth direction. And, an upper edge of the cam 22 forms a slanted surface 221 which is inclined at a predetermined angle, the slanted surface 221 is adequately formed in a front edge portion (right edge in the drawing) of the cam 22. And, the cam 22 is fixed in the shaft 21 and is moved integrally with the shaft 21.

Also, a spring 25 is provided between the second sliding guide 282 and the first stopper 26, the spring 25 is preferably a tension spring. And, in case the freezing chamber door 13 is closed, a front end of the shaft 21 is rearwardly pressed by the freezing chamber door 13. Accordingly, the spring 25 is maintained in a compressed state by the first stopper 26. And, the dragger 23 is disposed ahead of the cam 22.

Meanwhile, the opening/closing apparatus 20 disposed at the auxiliary drawer 15 includes a blocking projection 24 protruded from a lower end of the side surface of the auxiliary drawer 15.

Specifically, the edge portion in the lower end of the blocking projection 24 is formed to be inclined at a predetermined angle, as shown in the drawing. That is, a rear slanted surface 241 and a front slanted surface 242 are formed in a rear edge portion and a front edge portion, respectively.

The opening/closing apparatus 20 illustrated in FIG. 3 shows a state where the freezing chamber door 13 is closed or where the freezing chamber door 13 is opened while it is perpendicular to a floor.

Specifically, in case the spring 25 is compressed, the dragger 23 is disposed ahead of the cam 22 and the upper end of the dragger 23 is maintained to be spaced apart from the blocking projection 24 for a predetermined length. In this state, when freezing chamber door 13 is opened without being tilted, the main drawer 14 is only opened as the auxiliary drawer 15 is maintained its closed condition.

Figure 4:
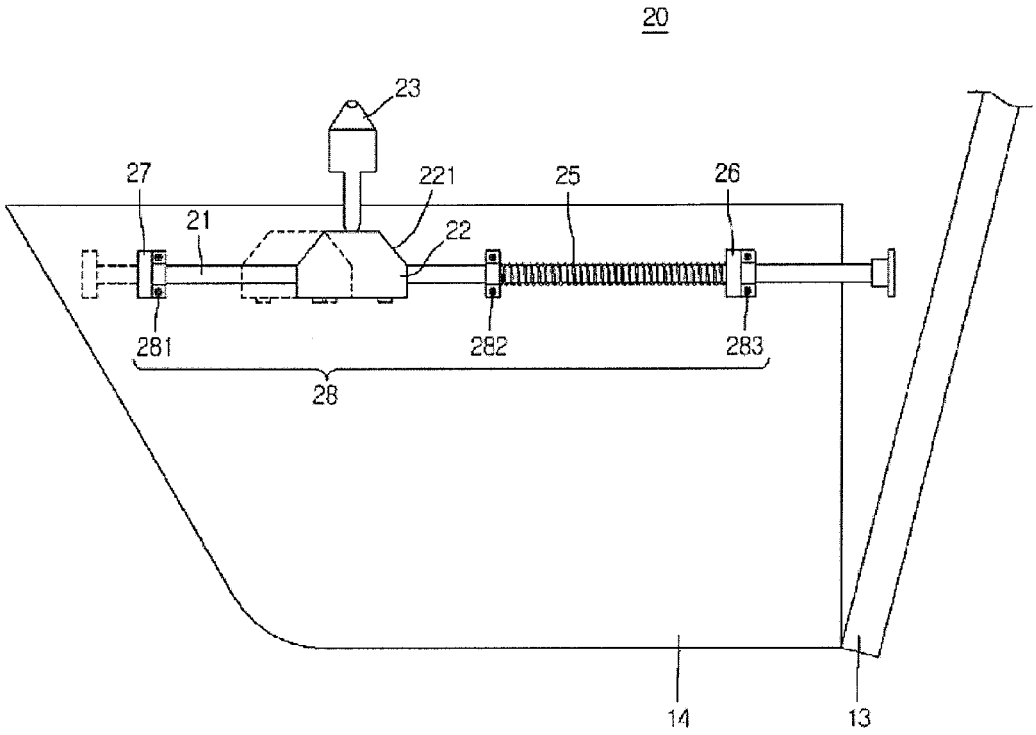
FIG. 4 is an operation state view showing an opening/closing apparatus, of which a main drawer and an auxiliary drawer are simultaneously opened, according to a preferred embodiment of the present invention.

FIG. 4 shows an opening/closing apparatus, of which a main drawer and an auxiliary drawer are simultaneously opened, according to the preferred embodiment of the present invention in an operation state view.

*Referring to FIG. 4, when the freezing chamber door 13 is opened in a forwardly tilted state, the first stopper 26 is forwardly moved by a restoring force of the spring 25. And, the first stopper 26 is forwardly moved for a distance corresponding to the length to be contacted with the third sliding guide 283. At the same time, the cam 22 is also forwardly moved.

Specifically, if the cam 22 is forwardly moved, the lower end of the dragger 23 is positioned at the upper surface of the cam 22 as it is lifted along the slanted surface 221 of the cam 22. In this state, if the main drawer 14 is forwardly moved, the upper end of the dragger 23 is forwardly moved in a state that it is fastened to the rear slanted surface 241 of the blocking projection 24. Therefore, the auxiliary drawer 15 is opened together with the main drawer 14.

More specifically, if the main drawer 14 is further forwarded from the moment the auxiliary drawer 15 is fully opened, the upper end of the dragger 23 is forwarded along the bottom surface and the rear slanted surface 241 of the blocking projection 24. And, if the main drawer 14 is fully opened, the dragger 23 is further forwarded as it is detached from the blocking projection 24.

Meanwhile, while the freezing chamber door 13 is closed, the auxiliary drawer 15 is closed by two methods.

Firstly, it is the case that the freezing chamber door 13 is maintained its tilted state until the auxiliary drawer 15 is fully closed.

Specifically, in case the freezing chamber door 13 in a tilted state is backwardly moved for a predetermined length, the operation is processed in order opposite to that used for opening the main drawer 14. That is, the dragger 23 pushes the front slanted surface 242 of the blocking projection 24 while maintaining the lifted state. And, in case the freezing chamber door 13 is reversely tilted to be perpendicular to the ground when the auxiliary drawer 15 is fully closed, the shaft 21 is retreated. And then, the dragger 23 is also lowered along the upper surface of the cam 22 and the slanted surface 221, the upper end of the dragger 23 is spaced from the bottom surface of the blocking projection 24. In this state, the freezing chamber door 13 is pushed and closed.

Meanwhile, the freezing chamber door 13 in a tilted state is retreated after the auxiliary drawer 15 is fully closed, the upper end of the dragger 23 is moved along the bottom surface and the front slanted surface 242 of the blocking projection 24. And, the dragger 23 is spaced from the blocking projection 24 when the freezing chamber door 13 is further retreated. And, the freezing chamber is closed when the freezing chamber door 13 is reversely tilted in a state that the main drawer 14 is fully inserted.

Secondly, it is the case that the freezing chamber door 13 is closed while the freezing chamber door 13 is reversely tilted and perpendicular to the ground.

Specifically, if the freezing chamber door 13 is reversely tilted and becomes vertical, the spring 25 is compressed and the shaft 21 and cam 22 are retreated. And then, the dragger 23 is also lowered along the slanted surface of the cam 22. Therefore, the upper end of the dragger 23 is spaced from the blocking projection 24.

*In this state, if the main drawer 14 is retreated, the front of the auxiliary drawer 15 is contacted to the rear of the freezing chamber door 13. And, if the the main drawer 14 is further retreated, the auxiliary drawer 15 is retreated and closed in a state that it is tightly contacted to the rear surface of the freezing chamber door 13.

Figure 5:
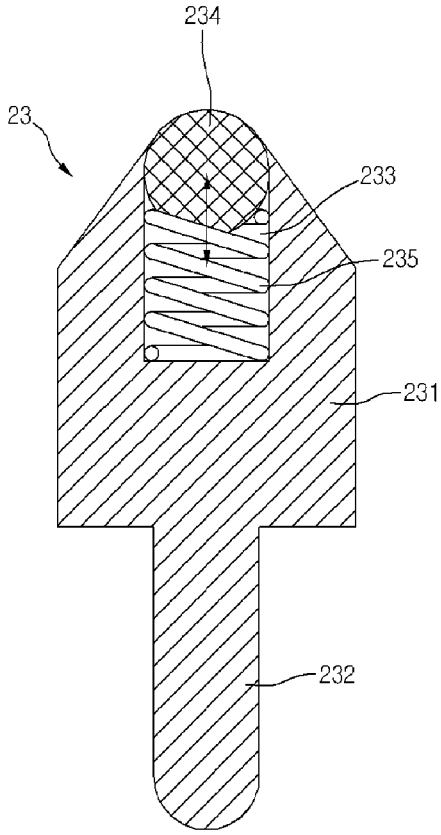
FIG. 5 is a cross-sectional view of a dragger constituting an opening/closing apparatus according to a preferred embodiment of the present invention.

FIG. 5 shows a dragger constituting an opening/closing apparatus according to a preferred embodiment of the present invention in a cross-sectional view.

Referring to FIG. 5, the dragger 23 according to the embodiment of the present invention includes a head 231, an elevating projection 232 extended from a bottom of the head 231 for a predetermined length, and a bearing 234 inserted into a top of the head 231.

Specifically, a depression 233 for accommodating a spring 235 is formed in the h head 231. And, the bearing 234 is seated on the upper side of the spring 235. Therefore, the bearing 234 is vertically moved by the extension and compression of the spring 235.

The operation of the dragger 23 according to the entry and exit of the freezing chamber door 13 will be explained in detail with reference to the accompanying drawings.

Figure 6:
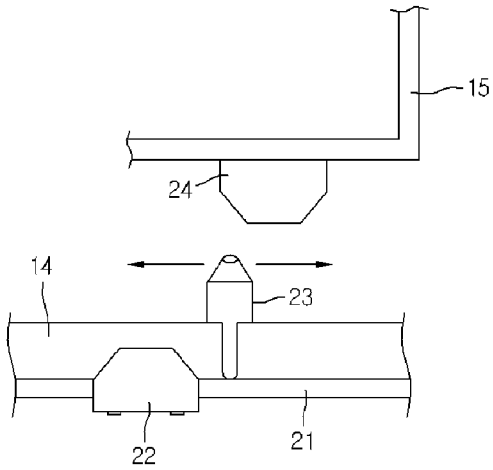
FIG. 6 is a schematic view showing an operational state of an opening/closing apparatus according to a preferred embodiment of the present invention, while a freezing chamber door is opened in a vertical state.

FIG. 6 schematically shows an operational state of an opening/closing apparatus according to a preferred embodiment of the present invention, while a freezing chamber door is opened in a vertical state.

*Referring to FIG. 6, as described in the above, the head 231 of the dragger 23 is moved in a state that it is tightly contacted to the upper surface of the main drawer 14. That is, since the upper end of the dragger 23 is forwarded in a state that it is spaced apart from the blocking projection 24, the auxiliary drawer 15 is not opened.

Figure 7:
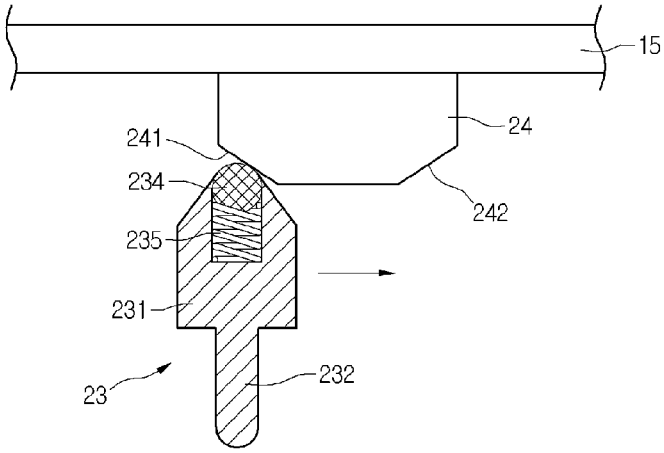
FIGS. 7 to 9 are views showing an operational state of a dragger according to a preferred embodiment of the present invention, while a freezing chamber door is opened in a tilted state.
Figure 8:
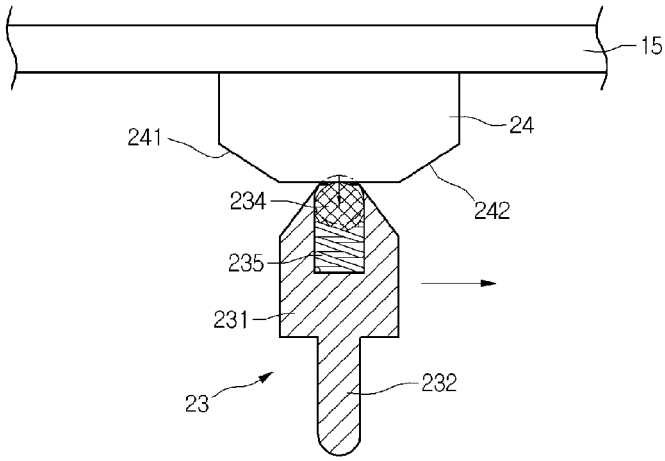
Figure 9:
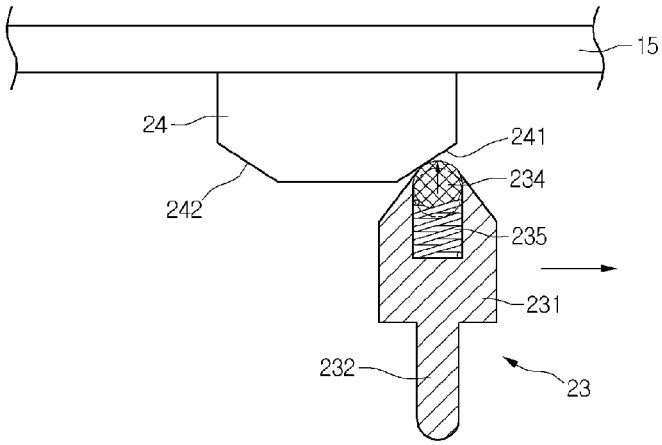

FIGS. 7 to 9 shows an operational state of a dragger according to a preferred embodiment of the present invention, while a freezing chamber door is opened in a tilted state.

Referring to FIGS. 7 to 9, if the freezing chamber door 13 is further drawn or pushed in a state that the dragger 23 is contacted to the slanted surface 241, 242 of the blocking projection 24, the bearing 234 is moved in a vertical direction.

In other words, while the dragger 23 is moved in a vertical direction, the bearing 234 is downwardly pressed by the front slanted surface 242 or rear slanted surface 241 of the blocking projection 24. Therefore, the bearing 234 is lowered, and thus, the spring 235 is compressed. On the contrary, the bearing 234 is raised by the restoring force of the spring 235 when the dragger 23 is detached from the blocking projection 24. By means of this operational process, the dragger 23 is smoothly moved in a back-and-forth direction.

According to this structure, the convenience of use is improved because the auxiliary drawer may be opened together with the main drawer depending on the user's selection, and the power consumption is reduced because the loss of cold air may be minimized.

The invention claimed is:

1. A refrigerator, comprising:

a body in which a cold air receiving space is provided;

a main drawer selectively drawn in or out of the cold air receiving space;

a door tiltably linked to a front of the main drawer to open/close the cold air receiving space;

an auxiliary drawer provided in the cold air receiving space, the auxiliary drawer located above the main drawer and selectively drawn in or out; and an opening/closing apparatus provided at one side of the main and auxiliary drawers, the opening/closing apparatus comprising:

a shaft selectively contacting the door;

an elastic member provided on an outer surface of the shaft, wherein one end of the elastic member contacts a first sliding guide fixed to a side surface of the main drawer and the other end of the elastic member contacts a stopper integrally coupled to the shaft; and a cam integrally coupled to the shaft; and a dragger provided on an upper end of the main drawer, and selectively contacting the cam by moving vertically, wherein when the door moves from a closed position to an opened position at a vertical state, the elastic member is maintained compressed and the main drawer is only withdrawn, and wherein when the door moves from the closed position to the opened position at a tilted state, the cam and the shaft move forward by an expansion of the elastic member, and the dragger is raised along the cam to contact the auxiliary drawer thereby, the auxiliary drawer is drawn out together with the main drawer.

2. The refrigerator according to claim 1, wherein the opening/closing apparatus further comprises a blocking projection which protrudes from a side surface of the auxiliary drawer, wherein the dragger selectively contacts the blocking projection when the dragger is raised.

3. The refrigerator according to claim 2, wherein when the door moves from the opened position to the closed position at a tilted state, the auxiliary drawer is drawn in by the dragger.

4. The refrigerator according to claim 3, wherein when the door moves from the opened position to the closed position at the tilted state, the dragger contacts the blocking projection, whereby the auxiliary drawer is drawn in together with the main drawer.

5. The refrigerator according to claim 2, wherein an upper end of the dragger is configured to maintain contact with the blocking projection until the auxiliary drawer is fully open, and configured to move forward along a bottom surface of the blocking projection and to be separated from the blocking projection if the main drawer is further drawn in a state that the auxiliary drawer is fully open.

6. The refrigerator according to claim 5, wherein the bottom surface of the blocking projection includes:

a front slanted surface formed at a front edge portion;

a rear slanted surface formed at a rear edge portion; and a flat surface between the front edge portion and the rear edge portion.

7. The refrigerator according to claim 5, wherein the dragger includes:

a head in which a spring is provided;

a bearing provided at a top of the head; and an elevating projection extended from a bottom of the head.

8. The refrigerator according to claim 7, wherein the bearing is configured to move up and down by the expansion and contraction of the spring while moving at a state in contact with the blocking projection.

9. The refrigerator according to claim 2, further comprising:

a second sliding guide fixed to the side surface of the main drawer at a position ahead the first sliding guide, to guide the movement of the shaft.

10. The refrigerator according to claim 9, wherein the stopper moves between the first and second sliding guides and the elastic member is placed between the stopper and the first sliding guide.

11. The refrigerator according to claim 10, wherein when the door is oriented in the vertical state, the stopper moves back to compress the elastic member and the cam moves back to be away from the dragger.

12. The refrigerator according to claim 11, wherein when the door moves from the closed position to the opened position at the vertical state, an upper end of the dragger is placed away from the blocking projection such that the auxiliary drawer is not withdrawn.

13. The refrigerator according to claim 10, wherein when the door is in the tilted state, the stopper moves forward to expand the elastic member and the cam moves towards the dragger such that the dragger is raised by moving along a surface of the cam.

* * * * *